US007455501B2

(12) United States Patent
Horng et al.

(10) Patent No.: US 7,455,501 B2
(45) Date of Patent: Nov. 25, 2008

(54) MINIATURE BLOWER FAN

(75) Inventors: Alex Horng, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 138 days.

(21) Appl. No.: 11/431,561

(22) Filed: May 11, 2006

(65) Prior Publication Data

US 2007/0196221 A1 Aug. 23, 2007

(30) Foreign Application Priority Data

Feb. 21, 2006 (TW) ..... 95105688 A

(51) Int. Cl.
*F04D 29/38* (2006.01)
*F04D 29/52* (2006.01)

(52) U.S. Cl. ..... 415/220; 415/229; 416/3; 416/174; 417/423.7; 417/423.12; 310/63; 310/67 R; 310/156.32; 310/268

(58) Field of Classification Search ..... 415/10, 415/220, 229; 416/3, 174; 417/423.7, 423.12, 417/423.13; 310/62–63, 67 R, 156.32, 268
See application file for complete search history.

(56) References Cited

U.S. PATENT DOCUMENTS

| | | | | |
|---|---|---|---|---|
| 4,164,690 | A * | 8/1979 | Muller et al. | 417/423.7 |
| 4,603,271 | A | 7/1986 | Maruyama et al. | |
| 5,176,509 | A * | 1/1993 | Schmider et al. | 417/423.7 |
| 5,217,351 | A | 6/1993 | Meier et al. | |
| 6,462,441 | B1 * | 10/2002 | Horng et al. | 310/67 R |
| 6,762,527 | B1 * | 7/2004 | Horng | 310/156.18 |

* cited by examiner

*Primary Examiner*—Christopher Verdier
(74) *Attorney, Agent, or Firm*—Muncy, Geissler, Olds & Lowe, PLLC

(57) ABSTRACT

A miniature blower fan includes an axial seat and a shaft extending from a central portion of the axial seat. A plurality of vanes and a magnet are mounted to an outer circumferential wall of the axial seat. The vanes extend radially outward from the outer circumferential wall of the axial seat and are spaced at regular intervals. The miniature blower fan further includes a casing having an air inlet. The vanes have a thickness larger than 30% of an overall height of the vanes and the magnet. In another embodiment, a web extends radially outward from the outer circumferential wall of the axial seat, the vanes are mounted to a side of the web, and the magnet is mounted to the other side of the web. The vanes have a thickness larger than 30% of an overall height of the web, the vanes, and the magnet.

4 Claims, 6 Drawing Sheets

MINIATURE BLOWER FAN

BACKGROUND OF THE INVENTION

1. Field of the Invention

The present invention relates to a miniature blower fan mounted in a miniature electronic system for dissipating heat for microchips in the electronic system.

2. Description of Related Art

FIG. 1 illustrates a conventional blower fan comprising an impeller 10 having an inner circumferential wall to which a magnet 11 is fixed. An axial seat 12 protrudes from a center of the impeller 10, and a shaft 13 is fixed to the axial seat 12. A web 14 extends radially outward from an outer circumferential wall of the impeller 10. A plurality of radially extending vanes 15 are formed on the web 14 and spaced at regular intervals. When the impeller 10 turns, the air currents on top of the impeller 10 are driven by the vanes 15 and output sideward for dissipating heat for an electronic system.

Due to developments in precision and complication of layouts of integrated circuits, complicated circuit designs cause rapid temperature rise of the microchips, especially for those in miniature electronic systems. Conventional solutions including increasing the heat-dissipating area by fins and using heat-conductive tubes to transfer heat energy fail in current systems in which the heat energy accumulates rapidly. Further, difficulties exist in miniaturization of the conventional blower structure such that the conventional blower structure could not be used in miniature electronic systems.

If the thickness of the above conventional blower fan is directly reduced for miniaturization purposes, the heat-dissipating capacity of the blower fan is adversely affected directly. This is because the space for installation of the stator is limited and large-power stator coils could not be used once the overall thickness of the impeller 10 is reduced. Further, reduction in the overall thickness of the blower fan also limits the area of the impeller 15. The speed of the air currents and the wind pressure are reduced.

Hence, to meet the requirements of the developments in precision and complication of layouts of integrated circuits, a novel miniature blower fan is required for solving the heat-accumulation problem, for assisting in rapid heat-dissipation for the microchips, and for maintaining normal operations of the whole system.

SUMMARY OF THE INVENTION

In accordance with an aspect of the present invention, a miniature blower fan comprises an axial seat and a shaft extending from a central portion of the axial seat. A plurality of vanes and a magnet are mounted to an outer circumferential wall of the axial seat. The vanes extend radially outward from the outer circumferential wall of the axial seat and are spaced at regular intervals. The miniature blower fan further comprises a casing having an air inlet. The vanes have a maximum diameter greater than a diameter of the air inlet of the casing. The magnet is covered by the vanes in rotation. The vanes have a thickness larger than 30% of an overall height of the vanes and the magnet.

Preferably, the magnet has a thickness smaller than 70% of the overall height of the vanes and the magnet.

The maximum diameter of the vanes is the same as or greater than that of the magnet.

In accordance with another aspect of the present invention, a miniature blower fan comprises an axial seat and a shaft extending from a central portion of the axial seat. A web extends radially outward from the outer circumferential wall of the axial seat. A plurality of vanes are mounted to a side of the web. A magnet is mounted to another side of the web. The vanes extend radially and are spaced at regular intervals. The magnet is covered by the vanes in rotation. The vanes have a thickness larger than 30% of an overall height of the web, the vanes, and the magnet.

Preferably, the magnet has a thickness smaller than 70% of the overall height of the web, the vanes and the magnet.

The vanes may be formed by punching the web.

The blower fan in accordance with the present invention meets the needs of electronic systems in the development trend of precision, complication and even miniaturization while meeting the requirements of the heat-dissipating capacity in terms of the amount of the output winds and the wind pressure, thereby providing excellent heat dissipation.

Other objects, advantages and novel features of this invention will become more apparent from the following detailed description when taken in conjunction with the accompanying drawings.

DETAILED DESCRIPTION OF THE PREFERRED EMBODIMENTS

The present invention relates to a miniature blower fan for dissipating heat for microchips in a miniature electronic system. Preferred embodiments of the present invention are now described with reference to the accompanying drawings.

Figure 1:
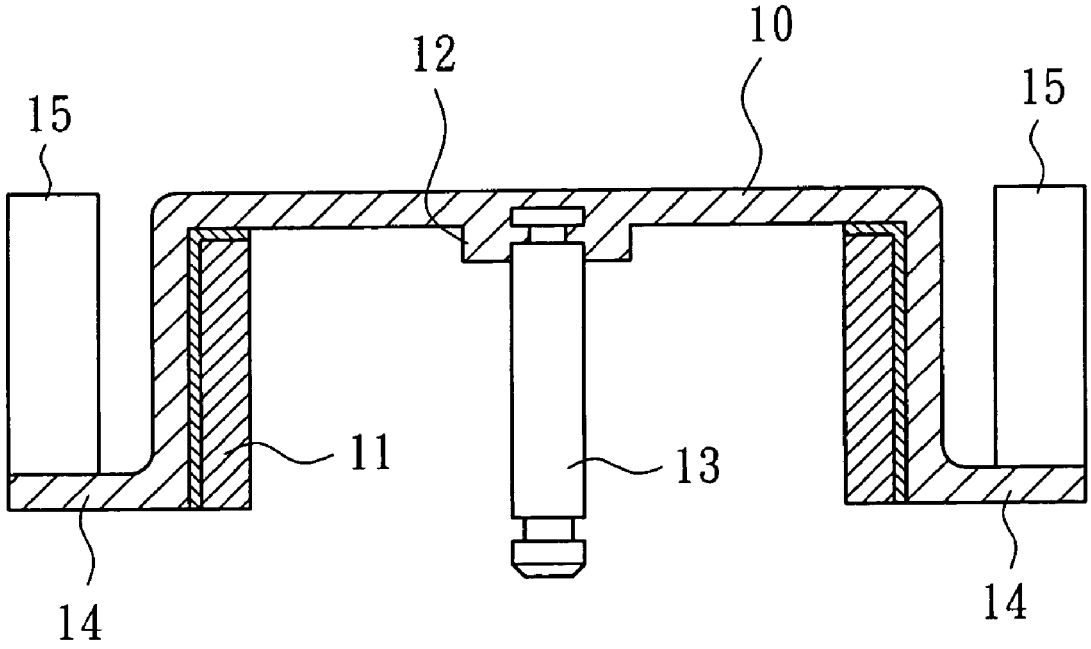
FIG. 1 PRIOR ART
FIG. 1 is a sectional view of a conventional blower fan.
Figure 2:
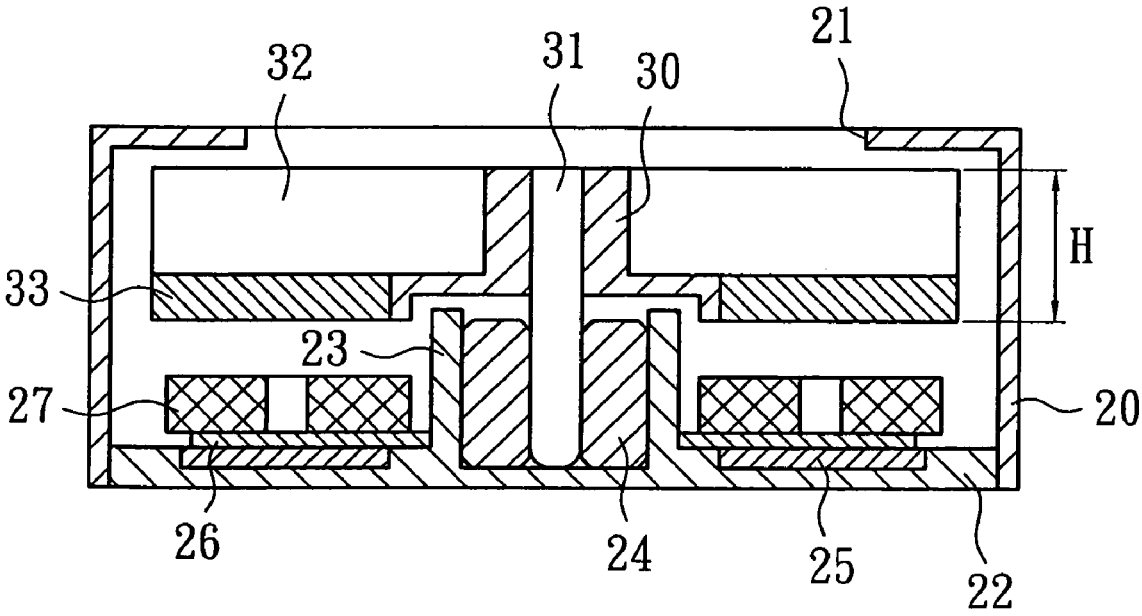
FIG. 2 is a sectional view of a first embodiment of a miniature blower fan in accordance with the present invention.
Figure 3:
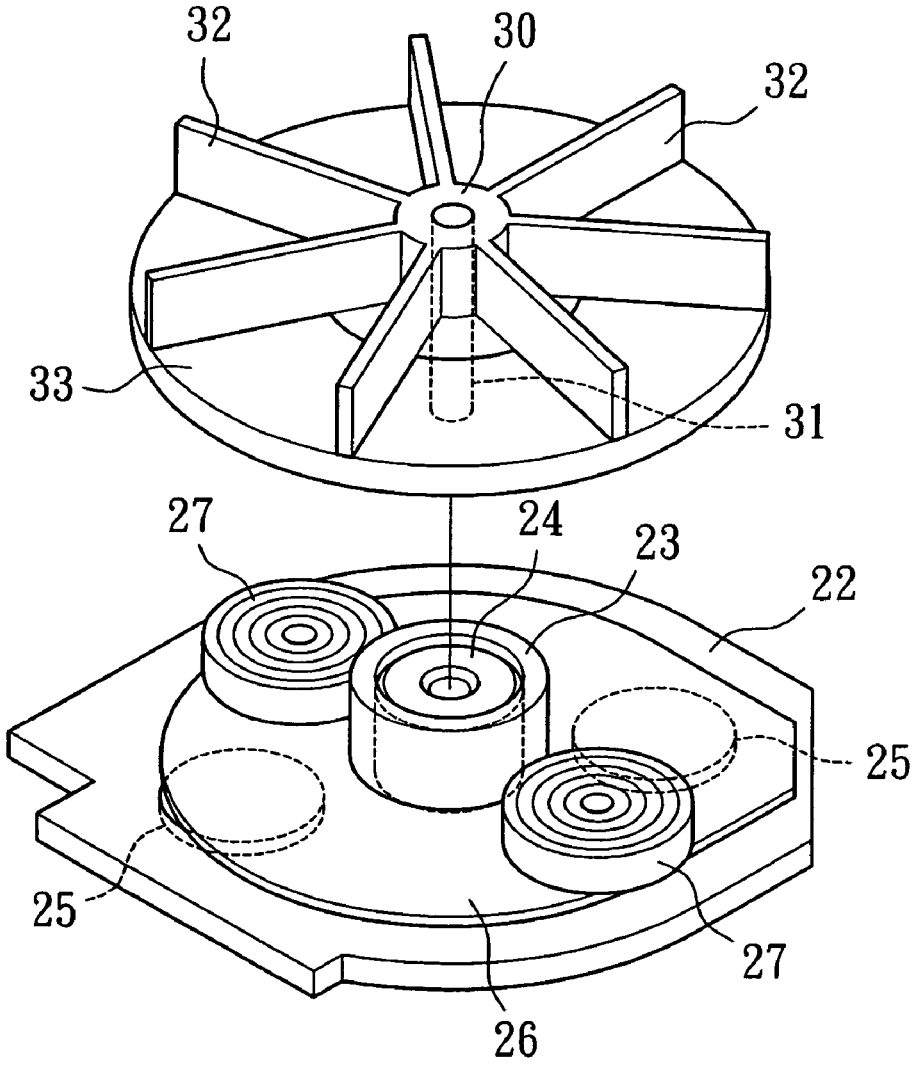
FIG. 3 is an exploded perspective view of the miniature blower fan in FIG. 2.

FIGS. 2 and 3 illustrate a first embodiment of a miniature blower fan in accordance with the present invention. The blower fan comprises an axial seat 30 and a shaft 31 coupled to a central portion of the axial seat 30. A plurality of vanes 32 and a magnet 33 are mounted to an outer circumferential wall of the axial seat 30. The vanes 32 extend radially outward from the outer circumferential wall of the axial seat 30 and are spaced at regular intervals. The magnet 33 is directly connected with the vanes 32 and covered by the vanes 32 in rotation.

In a case that the overall height of the vanes 32 and the magnet 33 is "H," the thickness of the vanes 32 must be larger than 30% of the overall height H whereas the thickness of the magnet 33 must be smaller than 70% of the overall height H.

The blower fan further comprises a base 22 on which an axial tube 23 is formed. A bearing 24 is mounted in the axial tube 23, and the shaft 31 is extended through an axial hole (not labeled) of the bearing 24. Two iron plates 25 are mounted outside the axial tube 23. A circuit board 26 and two coils 27 are then mounted on the base 22. Through magnetic energizing between the coils 27 and the magnets 33, the vanes 32 are driven to turn for driving air currents. The iron plates 25 provide a downward attracting force to the magnet 33, allowing stable rotation of the vanes 32 while preventing the shaft 31 from disengaging from the axial hole of the bearing 24.

A casing 20 is mounted above the base 22 and includes an air inlet 21 in association with the vanes 32. The air inlet 21 has a diameter smaller than the maximum diameter of the vanes 32.

Figure 4:
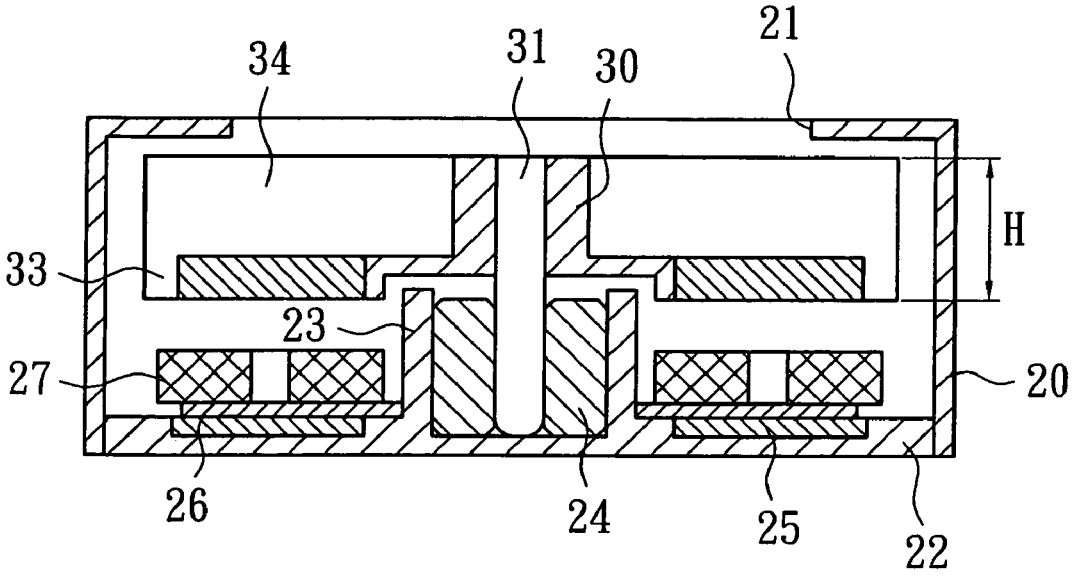
FIG. 4 is a sectional view of a second embodiment of the miniature blower fan in accordance with the present invention.

In the first embodiment shown in FIG. 2, the maximum diameter of the vanes 32 is the same as that of the magnet 33, providing a flat, flush design. In the second embodiment shown in FIG. 4, the maximum diameter of the vanes 34 is greater than that of the magnet 33 for increasing the contact area of the vanes 34 with the air currents and for increasing the speed of air currents and the wind pressure.

Figure 5:
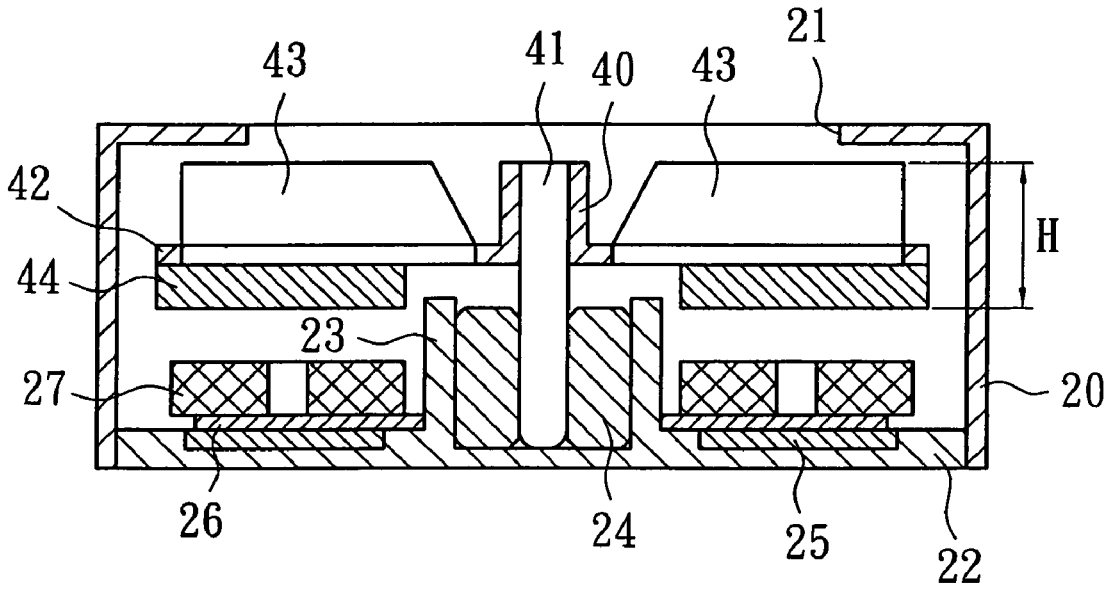
FIG. 5 is a sectional view of a third embodiment of the miniature blower fan in accordance with the present invention.
Figure 6:
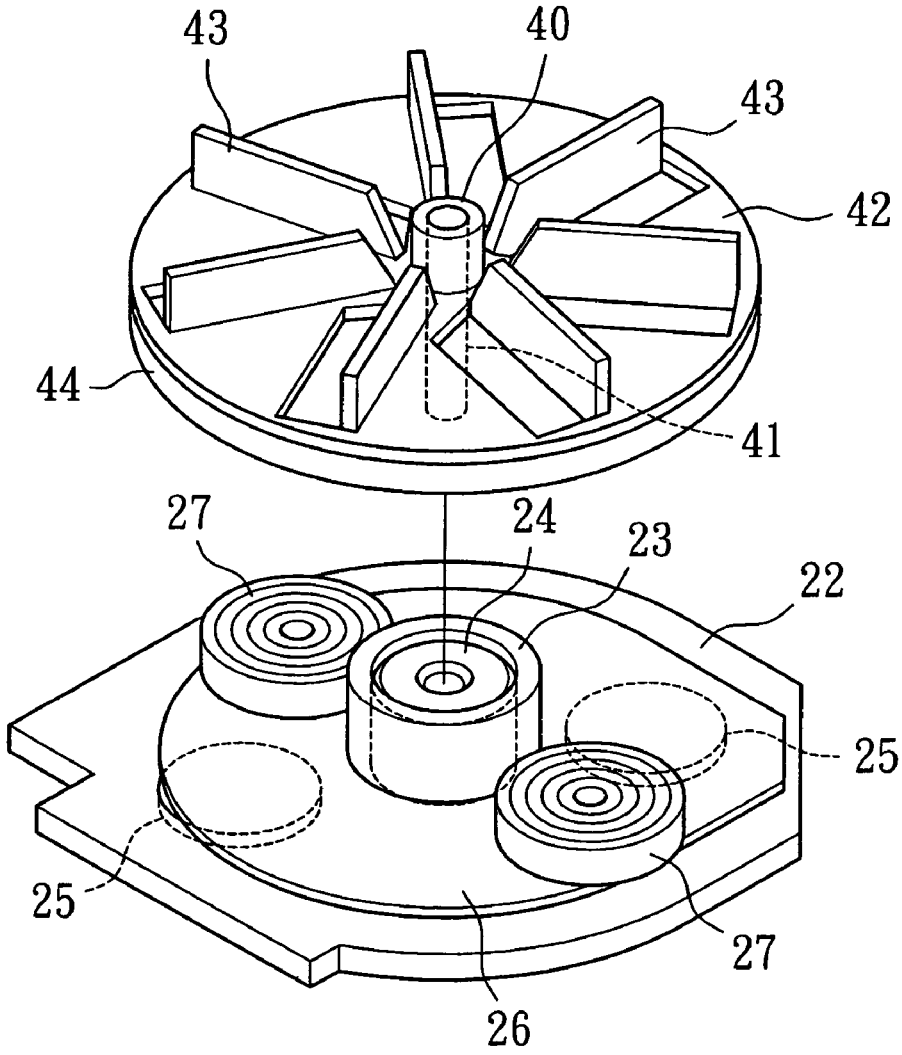
FIG. 6 is an exploded perspective view of the miniature blower fan in FIG. 5.

FIGS. 5 and 6 illustrate a third embodiment of the invention. The blower fan comprises an axial seat 40 and a shaft 41 coupled to a central portion of the axial seat 40. A web 42 extends radially outward from an outer circumferential wall of the axial seat 40. A plurality of vanes 43 are mounted to a side of the web 42 and a magnet 44 is mounted to the other side of the web 42, so that the vanes 43, the web 42 and the magnet 44 are arranged axially. The vanes 43 extend radially and are spaced at regular intervals. The magnet 44 is covered by the vanes 43 in rotation. In this embodiment, the vanes 43 are formed by punching the web 42.

In a case that the overall height of the web 42, the vanes 43, and the magnet 44 is "H," the thickness of the vanes 43 must be larger than 30% of the overall height H whereas the thickness of the magnet 44 must be smaller than 70% of the overall height H.

As apparent from the foregoing, the blower fan in accordance with the present invention meets the needs of electronic systems in the development trend of precision, complication and even miniaturization while meeting the requirements of the heat-dissipating capacity in terms of the amount of the output winds and the wind pressure, thereby providing excellent heat dissipation.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A miniature fan comprising an axial seat and a shaft extending from a central portion of the axial seat, a plurality of vanes and a magnet being mounted to an outer circumferential wall of the axial seat, the vanes extending radially outward from the outer circumferential wall of the axial seat and being spaced at regular intervals, the miniature blower fan further comprising a casing having an air inlet, the vanes having a maximum diameter greater than a diameter of the inlet of the casing, the magnet being covered by the vanes in rotation, the vanes having a thickness larger than 30% of an overall height of the vanes and the magnet, the magnet being directly connected with the vanes.

2. The miniature blower fan as claimed in claim 1, wherein the magnet has a thickness smaller than 70% of the overall height of the vanes and the magnet.

3. The miniature blower fan as claimed in claim 1, wherein the maximum diameter of the vanes is the same as that of the magnet.

4. The miniature blower fan as claimed in claim 1, wherein the maximum diameter of the vanes is greater than that of the magnet.

* * * * *